US009041369B2

(12) United States Patent
Richter et al.

(10) Patent No.: US 9,041,369 B2
(45) Date of Patent: May 26, 2015

(54) METHOD AND APPARATUS FOR OPTIMIZING LINEAR REGULATOR TRANSIENT PERFORMANCE

(75) Inventors: Elkana Richter, Tene-omarim (IL); Yossi Hassan, Ashkelon (IL); Tomer Elran, Petah Tikva (IL)

(73) Assignee: SanDisk Technologies Inc., Plano, TX (US)

( * ) Notice: Subject to any disclaimer, the term of this patent is extended or adjusted under 35 U.S.C. 154(b) by 230 days.

(21) Appl. No.: 13/594,270

(22) Filed: Aug. 24, 2012

(65) Prior Publication Data

US 2014/0055110 A1 Feb. 27, 2014

(51) Int. Cl.
*G05F 1/565* (2006.01)
*G05F 1/575* (2006.01)

(52) U.S. Cl.
CPC ..... *G05F 1/565* (2013.01)

(58) Field of Classification Search
USPC ..... 323/266, 267, 271–289
See application file for complete search history.

(56) References Cited

U.S. PATENT DOCUMENTS

| | | | | |
|---|---|---|---|---|
| 4,929,884 | A * | 5/1990 | Bird et al. | 323/313 |
| 6,396,249 | B1 * | 5/2002 | Itakura et al. | 323/273 |
| 6,522,112 | B1 | 2/2003 | Schmoock et al. | |
| 7,205,828 | B2 | 4/2007 | Sridharan | |
| 7,227,426 | B2 * | 6/2007 | Kaizuka | 331/186 |
| 7,304,539 | B2 * | 12/2007 | Tsurumaki et al. | 330/285 |
| 7,772,816 | B2 * | 8/2010 | Cho et al. | 323/280 |
| 7,859,134 | B2 | 12/2010 | Chi et al. | |
| 7,888,925 | B2 | 2/2011 | Dequina | |
| 8,072,196 | B1 | 12/2011 | Li | |
| 2004/0046609 | A1 * | 3/2004 | Xu | 330/296 |
| 2005/0194623 | A1 * | 9/2005 | Scollo et al. | 257/291 |
| 2006/0170401 | A1 * | 8/2006 | Chen et al. | 323/273 |
| 2008/0088286 | A1 * | 4/2008 | Cho et al. | 323/280 |
| 2009/0001948 | A1 * | 1/2009 | Martinez et al. | 323/271 |
| 2009/0224737 | A1 * | 9/2009 | Lou | 323/280 |
| 2010/0277148 | A1 | 11/2010 | Zhao et al. | |
| 2011/0101934 | A1 * | 5/2011 | Lopata et al. | 323/271 |
| 2011/0204860 | A1 * | 8/2011 | Thiele et al. | 323/271 |
| 2012/0086420 | A1 | 4/2012 | Simmons et al. | |

OTHER PUBLICATIONS

LDCL015XX/LDCL015XX33, "150 mA Capless Ultra Low Drop Linear Regulator ICs" dated Dec. 2011.

* cited by examiner

*Primary Examiner* — Adolf Berhane
*Assistant Examiner* — Nusrat Quddus
(74) *Attorney, Agent, or Firm* — Brinks Gilson & Lione

(57) ABSTRACT

A voltage regulator compensation circuit provides power to a dynamic load and includes a power transistor configured to drive the dynamic load, a reference determining transistor configured to establish a voltage reference proportional to a regulated output voltage of the power transistor, and a control circuit coupled to a gate input of both the power transistor and the reference determining transistor. Also included is a comparison engine configured to compare the regulated output voltage and the voltage reference, and a current consuming transistor operatively coupled to an output of the power transistor and configured to provide a varying secondary load. The comparison engine is configured to control the current consuming transistor to increase current draw or decrease current draw from the power transistor based on the difference between the regulated output voltage and the voltage reference.

25 Claims, 9 Drawing Sheets

METHOD AND APPARATUS FOR OPTIMIZING LINEAR REGULATOR TRANSIENT PERFORMANCE

TECHNICAL FIELD

This application relates generally to voltage regulator circuits, and more specifically to circuits for improving the transient response of linear voltage regulators.

BACKGROUND

Linear voltages regulators are used to maintain a constant output voltage. Linear voltage regulators include some form of amplifier, and some include feedback or a feedback loop to control the amplifier to as to maintain a constant output voltage.

Linear voltage regulators are often integrated into various semiconductor devices, such as Micro SD memory devices, SD memory devices, iNAND memory devices, and other memory devices, such as those available from SanDisk Corp. of California. These memory devices may be susceptible small changes or spikes in output voltage of the linear voltage regulator during current transients, such as when a load turns on and begins to draw current and turns off and ceases to draw current.

For example, a current transient load of an internal circuit component may change from an "off" or unloaded state drawing about 1 uA, to an "on" or loaded state drawing about 1 mA. This can cause the output voltage to drop from about 1.20V to about 1.13V. Such a transient or spike in the output voltage can cause a malfunction in the memory circuit in which the linear regulator is supplying regulated voltage.

Memory devices, such as for example, the flash memory devices and other memory devices mentioned above, have been widely adopted for use in consumer products. Flash memory may be found in different forms, for example in the form of a portable memory card that can be carried between host devices or as a solid state drive (SSD) embedded in a host device. Two general memory cell architectures found in flash memory include NOR and NAND. In a typical NOR architecture, memory cells are connected between adjacent bit line source and drain diffusions that extend in a column direction with control gates connected to word lines extending along rows of cells. A memory cell includes at least one storage element positioned over at least a portion of the cell channel region between the source and drain. A programmed level of charge on the storage elements thus controls an operating characteristic of the cells, which can then be read by applying appropriate voltages to the addressed memory cells.

A typical NAND architecture utilizes strings of more than two series-connected memory cells, such as 16 or 32, connected along with one or more select transistors between individual bit lines and a reference potential to form columns of cells. Word lines extend across cells within many of these columns. An individual cell within a column is read and verified during programming by causing the remaining cells in the string to be turned on so that the current flowing through a string is dependent upon the level of charge stored in the addressed cell.

NAND flash memory can be fabricated in the form of single-level cell flash memory, also known as SLC or binary flash, where each cell stores one bit of binary information. NAND flash memory can also be fabricated to store multiple states per cell so that two or more bits of binary information may be stored. This higher storage density flash memory is known as multi-level cell or MLC flash. MLC flash memory can provide higher density storage and reduce the costs associated with the memory. The higher density storage potential of MLC flash tends to have the drawback of less durability than SLC flash in terms of the number write/erase cycles a cell can handle before it wears out. MLC can also have slower read and write rates than the more expensive and typically more durable SLC flash memory. Memory devices, such as SSDs, may include both types of memory.

With respect to conventional memory circuits, and semiconductor devices generally, such devices may use an external type voltage regulator. External type voltage regulators may use a relatively large output capacitor to absorb a transient. This is often disadvantageous because it requires an additional component. Further, use of an external capacitor is not practical when the linear voltage regulator circuit is formed or integrated into a semiconductor circuit. Capacitors of sufficient size can be formed in an integrated circuit, but such fabrication consumes an unacceptable amount of expensive silicon area and is often impractical to implement.

SUMMARY

A voltage regulator compensation circuit is disclosed that improves the transient response of a linear voltage regulator by providing a dynamically varying compensation load, which minimizes transients and spikes on the regulated voltage output of the linear voltage regulator when the dynamic load is in transition.

According to one aspect of the invention, a voltage regulator compensation circuit provides power to a dynamic load and includes a power transistor configured to drive the dynamic load, a reference determining transistor configured to establish a voltage reference proportional to an output voltage of the power transistor, and a control circuit coupled to a gate input of both the power transistor and the reference determining transistor. Also included is a comparison engine configured to compare the output voltage and the voltage reference, and a current consuming transistor operatively coupled to an output of the power transistor and configured to provide a varying secondary load. The comparison engine is configured to control the current consuming transistor to increase current draw or decrease current draw from the power transistor based on the difference between the output voltage and the voltage reference.

Other methods and systems, and features and advantages thereof will be, or will become, apparent to one with skill in the art upon examination of the following figures and detailed description. It is intended that the scope of the invention will include the foregoing and all such additional methods and systems, and features and advantages thereof.

BRIEF DESCRIPTION OF THE DRAWINGS

The components in the figures are not necessarily to scale, emphasis instead being placed upon illustrating various aspects thereof. Moreover, in the figures, like referenced numerals designate corresponding parts throughout the different views.

DETAILED DESCRIPTION

Figure 1:
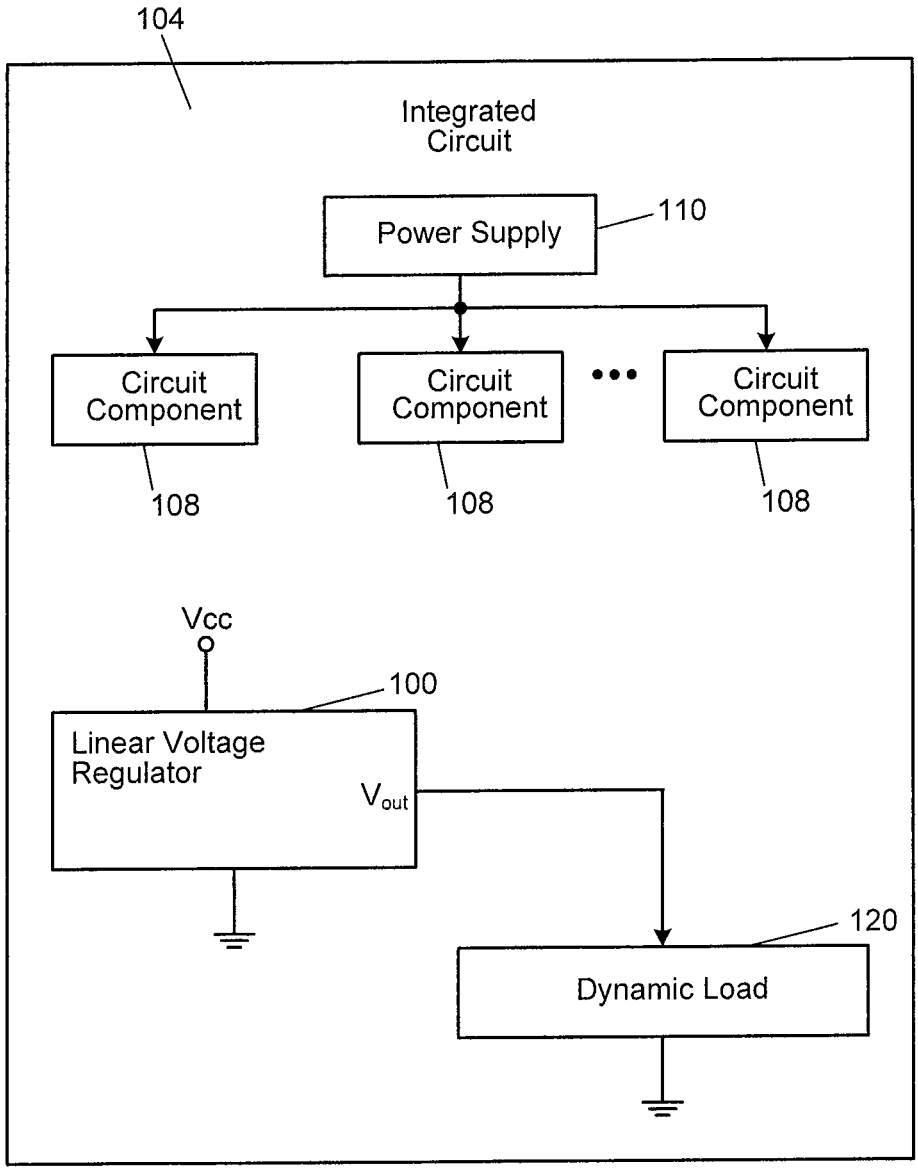
FIG. 1 is a block diagram of a known integrated circuit having a linear voltage regulator.

FIG. 1 shows a known linear voltage regulator 100 formed in an integrated circuit 104, such as a memory circuit. The linear voltage regulator 100 is coupled between a voltage source, Vcc, and ground. The integrated circuit 104 contains various circuit blocks or components 108, which are shown in block format. Some of the circuit blocks 108 may obtain power from the main power source 110 internal to the integrated circuit 104, while other circuit blocks may obtain power from the linear voltage regulator 100, which is also integrated into the integrated circuit 104. The main internal power source 110 may also be a linear voltage regulator, but typically provides a greater amount of power output than is provided by the linear voltage regulator 100.

In that regard, the main internal power source 110 of the integrated circuit 104 may provide power to certain circuits that are either always active, or active and consuming power most of the time. Such circuit blocks 108 may include a CPU, controller, memory refresh circuits, and the like.

The linear voltage regulator 100, however, may provide power to certain circuits that are more dynamic in nature, and which vary dynamically with respect to the power consumption, such as a dynamic load 120 shown in FIG. 1. Preferably, the linear voltage regulator 100 consumes much less power that the main internal power supply 110. Such dynamically varying blocks or loads, such as the dynamic load 120, may include components relating to data transfer, such as input and output circuits, transceiver circuits, cache circuits, and the like, which are typically active only during data transfer, and often represent a low "duty cycle" component.

Figure 2:
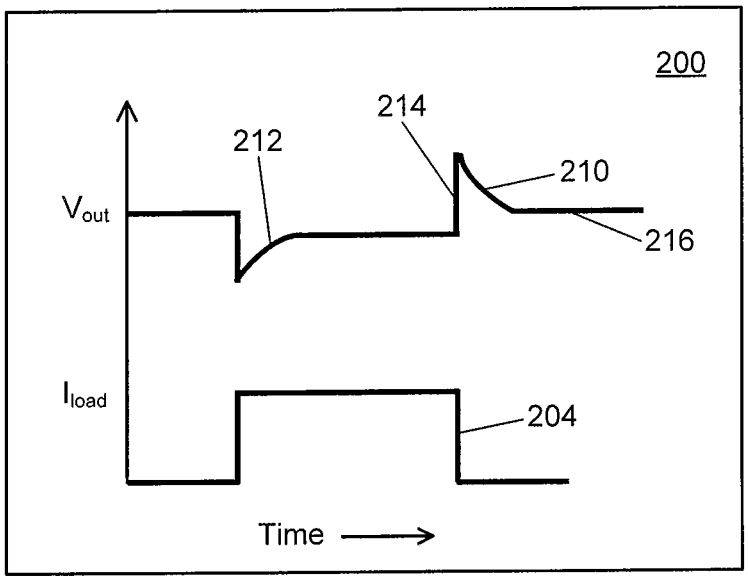
FIG. 2 is a waveform showing load current and regulator voltage output of the voltage regulator of FIG. 1.

FIG. 2 is a graph 200 showing load current 204 of the dynamic load 120 on the lower panel, and output voltage $V_{out}$ 210 of the linear voltage regulator 100 of FIG. 1 in response to the dynamic load, on the upper panel. When the dynamic load 120 is in an off state, the load current is zero or very close to zero. When the dynamic load 120 turns on, the load current increases very quickly to a maximum value. The change in load current causes a small decrease, spike, or transient 212 in the output voltage. Similarly, when the dynamic load turns off, the load current decreases very quickly, and thus causes another small increase, spike, or transient 214 in the output voltage before reaching steady state 216. Such spikes or transients in the output voltage may adversely affect operation of the dynamic load component 120 in the integrated circuit 104.

Figure 3:
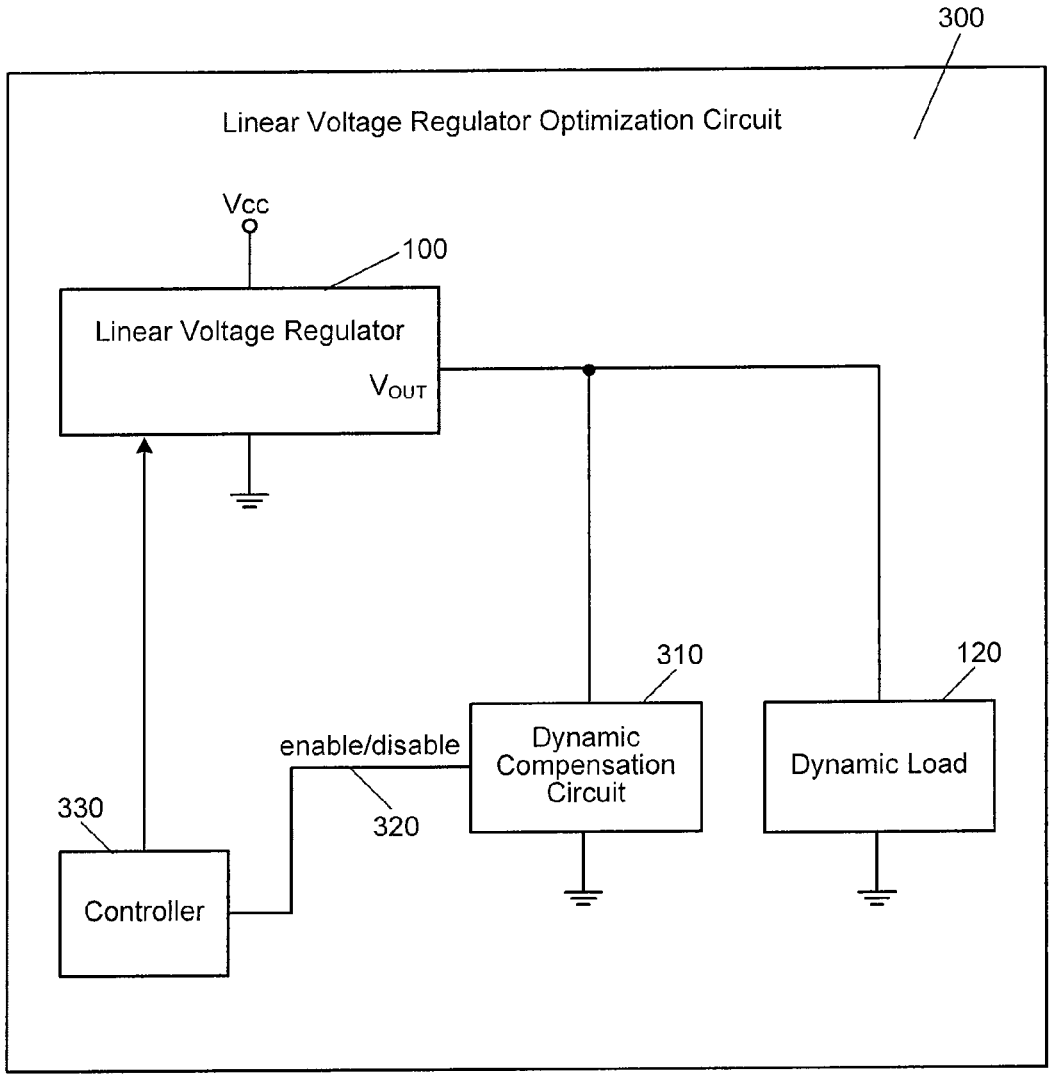
FIG. 3 is a block diagram showing one embodiment of the present invention having a dynamic compensation circuit.

FIG. 3 is a block diagram of one embodiment of a linear voltage regulator optimization circuit 300 including the linear voltage regulator 100, the dynamic load 120, and a dynamic compensation circuit 310. In operation, the dynamic compensation circuit 310 consumes a small amount of current at the output of the linear voltage regulator 100 when the current drawn by the dynamic load 120 is less than a certain threshold current. This maintains a minimum load current on the output of the linear voltage regulator 100, which improves the transient output response of the linear voltage regulator 100.

Thus, when the dynamic 120 load draws less than a minimum amount of current, that is, less than the current threshold, the dynamic compensation circuit 310 is activated and draws a minimum amount of current from the linear voltage regulator 100 such that there is always a certain minimum current drawn. Conversely, when the dynamic load 120 is active and draws more than the minimum amount of current, that is, when the dynamic load 120 is on, the dynamic compensation circuit 310 is essentially inactive, and does not draw additional current from the linear voltage regulator 100, thus leaving only the dynamic load 120 to draw current. This avoids increasing the overall load current when the total dynamic power is relatively high.

The dynamic compensation circuit 310 includes an enable/disable input 320, which may be controlled by a controller 330. Applying a disable signal completely turns off the dynamic compensation circuit 310 in situations when no current draw is expected for a predictable amount of time, such as when the integrated circuit 104 or specific components or circuits are in a "sleep state" or a stand-by power state.

Figure 4:
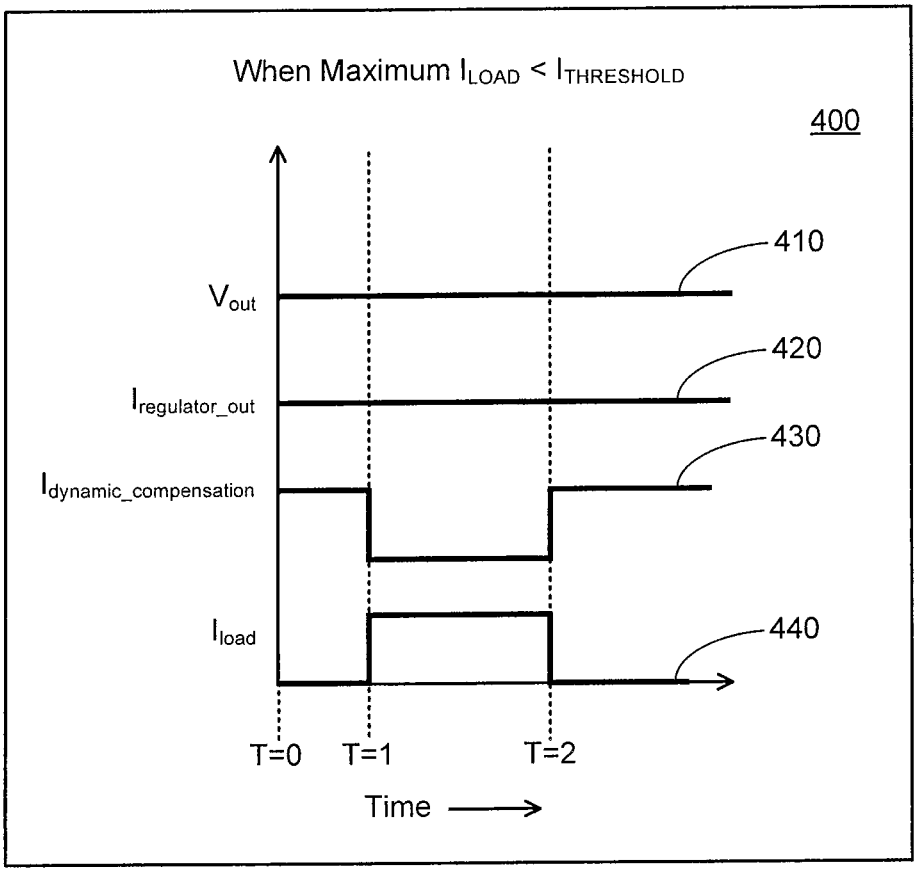
FIG. 4 is a waveform showing load current and regulator voltage output.

FIG. 4 is a graph 400 showing the output voltage ($V_{out}$) 410 of the linear voltage regulator 100, the total current drawn from the voltage regulator ($I_{regulator_out}$) 420, the current drawn by the dynamic compensation circuit ($I_{dynamic_compensation}$) 430, and the current drawn 440 by the dynamic load ($I_{load}$). These waveforms are applicable when the maximum dynamic load ($I_{load}$) is less than the current threshold ($I_{threshold}$).

As shown, from time=$T_0$ to $T_1$, $I_{load}$ is low because the dynamic load 120 is inactive. Because the dynamic load 120 is not drawing sufficient current, meaning the current load on the linear voltage regulator 100 is less than the threshold current, the dynamic compensation circuit 310 is active and draws a minimum amount of current, shown as $I_{dynamic_compensation}$ 430.

At time=$T_1$ and extending through time=$T_2$, the dynamic load 120 is active or in an on state. Accordingly, the dynamic compensation circuit 310 turns off, and thus $I_{dynamic_compensation}$ 430 is at minimum value. After time=$T_2$, the dynamic load 120 again turns off. Based on the mutual interaction and current draw from the dynamic load 120 and the dynamic compensation circuit 310, the output voltage $V_{out}$ 410 of the linear voltage regulator 100 and the current drawn from the linear voltage regular ($I_{regulator_out}$) 420, remain relatively constant.

Figure 5:
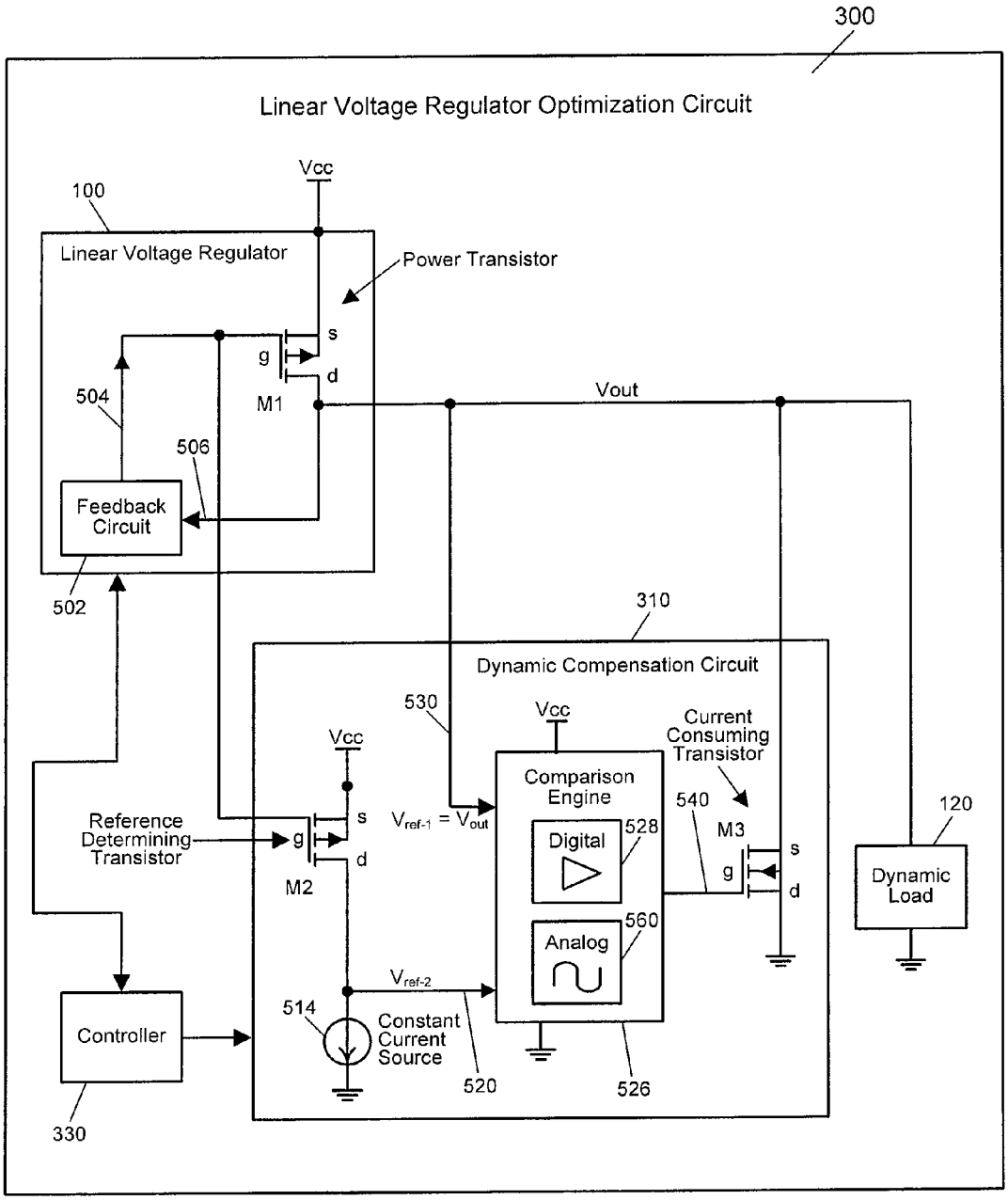
FIG. 5 is a block diagram of one embodiment of a linear voltage regulator optimization circuit.

FIG. 5 shows portions of the linear voltage regulator optimization circuit 300, in greater detail. The linear voltage regulator 100 may be a known configuration and may be formed in a known semiconductor process, and may further utilize a known feedback circuit 502 to perform voltage regulation.

In one embodiment of the invention, the linear voltage regulator 100 may include a power transistor M1 having its gate input coupled to an output or control signal 504 of the feedback circuit 502. The drain of the power transistor M1, which provides the regulated voltage output, $V_{out}$, may be coupled to an input 506 of the feedback circuit 502, while the source and substrate of the power transistor M1 may be coupled to power or Vcc. The drain of the power transistor M1 drives the dynamic load 120 and provides the regulated output voltage $V_{out}$.

The feedback circuit 502 of the linear voltage regulator 100 senses or monitors the voltage output ($V_{out}$) of the power transistor M1 and varies the gate voltage of M1 so as to maintain a constant voltage level for $V_{out}$, subject to certain constraints. The integrated circuit 104, such as a flash memory circuit, typically is supplied with Vcc=3.3 volts, while $V_{out}$ is typically 1.2 volts, although other voltage ranges may be used depending upon the semiconductor process and application.

In one embodiment, the dynamic compensation circuit 300 may also include a reference determining transistor M2, which is preferably the same type of transistor as power transistor M1, but fabricated on a smaller scale (lower power) than power transistor M1. The gate input of reference determining transistor M2 may be coupled to the gate input of power transistor M1, with both gates being identically controlled by the output of the feedback circuit 502.

Similarly, the source and substrate of reference determining transistor M2 may be coupled to Vcc. The drain of reference determining transistor M2 may be coupled to a constant current source 514 and to a reference input 520 ($V_{ref\text{-}2}$) of a comparison engine 526. Another reference input or a second signal input 530 (Vref−1) to the comparison engine 526, may be coupled to $V_{out}$. Note that $V_{out}$ is the same point as $V_{ref\text{-}2}$, but is referred to as $V_{ref\text{-}2}$ so as to further illustrate that such an input represents one of two reference inputs to the differential amplifier or comparison engine 526.

An output 540 of the comparison engine 526 drives a current consuming transistor M3. The drain of the current consuming transistor M3 is coupled to ground while the source and substrate of the current consuming transistor M3 may be coupled to $V_{out}$.

The comparison engine 526 may be a digital comparator 528, or preferably may be an analog comparator circuit 560 that provides a continuously varying proportional analog output, such as a differential operational amplifier circuit.

With respect to the operation of the linear voltage regulator optimization circuit 300 and FIG. 5, the gate control voltage of power transistor M1 (which is the same as the gate voltage of the reference determining transistor M2), and $V_{out}$ are used to establish a minimum threshold current provided by the linear voltage regulator 100, which determines when the current consuming transistor M3 will be turned on and turned off, at to what degree.

As discussed above, when the dynamic load 120 is inactive or off, the dynamic compensation circuit 310 causes additional current to be drawn from the power transistor M1 (via the current consuming transistor M3) so as to maintain a relatively constant or minimum current load at the output of the linear voltage regulator 100, at least until the current threshold is exceeded.

Such additional current is drawn or "consumed" when the comparison engine 526 turns on current consuming transistor M3 such that current flows from source to drain of the current consuming transistor M3. The fabricated size of current consuming transistor M3 may determine the maximum amount of current that current consuming transistor M3 may draw. This avoids the need to fabricate additional resistive elements into the circuit to limit the current consumption. Alternatively, a resistive element may be included to limit the current flow through the current consuming transistor M3.

Note that in the embodiment in which the comparison engine 526 is in the form of the digital comparator 528, the output of such a digital comparator circuit 528 is either 0 or 1. Thus, based on the output of the digital comparator circuit 528, the current consuming transistor M3 is either turned on or it is turned off. Accordingly, current consuming transistor M3 is drawing either no current (minimum current-leakage current) or maximum current.

However, in the preferred embodiment in which the comparison engine 526 provides a continuously varying proportional analog output by use of the analog comparator circuit 560 to the gate of the current consuming transistor M3, the current consuming transistor M3 need not be limited to only on or off states, and may be driven across a range of operating points. Thus, current consuming transistor M3 may be controlled to provide a smooth range of current consumption from zero (or some minimum or leakage value) to a maximum value. In some embodiments, the current consuming transistor M3 may be controlled to provide a linear range of current consumption.

Alternatively, the comparison engine 526 may provide a discrete number of output step voltages so as to control the current consuming transistor M3 in accordance with a plurality of current draw steps or a plurality of discrete operating points.

The threshold current, corresponding to the reference voltage, $V_{ref\text{-}2}$, is used by the comparison engine 526, whether in the form of the digital comparator 528 or analog comparison engine 560, to control the current consuming transistor M3. The threshold current is proportional to the minimum amount of current flowing from source to drain in power transistor M1. As described above, if the dynamic load 120 is off or does not otherwise draw a sufficient amount of current from power transistor M1, meaning the current draw is less than the threshold current, the current consuming transistor M3 is turned on or its operating point is changed, by the comparison engine 526 so that additional current is drawn or "consumed." Thus, current consuming transistor M3 acts as a secondary or additional load. Note that the reference voltage, $V_{ref\text{-}2}$, varies as a function of the load on the power transistor M1.

Conversely, when the dynamic load 120 turns on or begins to otherwise draw a sufficient amount of current from power transistor M1, meaning the current draw is greater than the threshold current, current consuming transistor M3 is turned off or its operating point is changed, by the comparison engine 526 so that additional current is not drawn or "consumed." Thus, current consuming transistor M3 is essentially disconnected from the circuit.

Regarding the relationship between the power transistor M1 and reference determining transistor M2, the voltage output of the reference determining transistor M2, as seen at its drain output, tracks the gate voltage of power transistor M1. In one embodiment, this may be done by fabricating transistors M1 and M2 in the same way, from the same material, using the same fabrication process, and biasing the respective transistors M1 and M2 at very similar operating points.

As shown in FIG. 5, transistors M1 and M2 may be controlled in exactly the same way because both gates are coupled to the same control signal, namely the output or control signal 504 of the feedback circuit 502. Note that the output voltage at the drain of transistors M1 and M2 will not be the same in magnitude, but will be proportional.

Of course, for reasons of power consumption, the reference determining transistor M2 is preferably fabricated on a much smaller scale than power transistor M1. For example, the scaling factor between transistor M1 and M2 may be 100:1. Accordingly the current flowing from source to drain in power transistor M1 may be 100 times greater than the current flowing from source to drain in reference determining transistor M2. In such a situation, the geometric dimensions may be scaled accordingly, and using the above ratio, the power consumption of the reference determining transistor M2 may be 1% of the power consumption of the power transistor M1. Of course, any suitable scaling factor may be used.

With regard to the transistors in the linear voltage regulator optimization circuit 300, power transistor M1 may be a high-power p-type MOSFET, but may also be an n-type transistor, providing of course, that the operating polarities are accounted for. The power transistor M1 is preferably a MOSFET, because most dense integrated circuits, including the memory circuit in which the linear voltage regulator optimization circuit 300 is formed, are typically formed using CMOS technology, due to low power consumption and high density. However, any suitable fabrication technology, such as NMOS, PMOS, CMOS (metal oxide semiconductor), bipolar etc., can be used. The above is also true for the reference determining transistor M2 and the current consuming transistor M3, as well as for all the other components in the linear voltage regulator optimization circuit 300. Note that in the illustrated embodiment, transistors M1 and M2 are p-type transistors, while transistor M3 is an n-type transistor. However, either type of transistor can be used assuming that the proper polarities are accounted for.

In operation, as the dynamic load 120 turns on and draws current, $V_{out}$ begins to fall. Accordingly, the feedback circuit 502 attempts to compensate by adjusting the gate signal of power transistor M1. The adjusted gate signal is mirrored on the gate input of reference determining transistor M2.

Note that as the control signal 504 applied to the gate of the reference determining transistor M2 begins to increase (as would happen when the feedback circuit 502 begins to boost the gate signal in response to a drop in $V_{out}$), the current flow through the reference determining transistor M2 tries to increase as the transistor turns on to a greater degree. However, the current flow through the reference determining transistor M2 is maintained at a constant level by the constant current source 514. Thus, to compensate, the voltage output of the reference determining transistor M2 ($V_{ref\text{-}2}$) must increase.

Note that the constant current source 514 may be a known configuration and may be formed from operation amplifiers as a current mirror, or may be formed using transistor circuits, whether MOSFETs, FETs (field effect transistors), JFETs (junction field effect transistors) and the like, Zener diodes, resistive integrated components, other linear regulators circuits, such as equivalents to the LM317 discrete linear regulator, and the like. Any suitable constant current source 514 able to be fabricated using the semiconductor processes described above, may be used.

This difference between $V_{ref\text{-}1}$ (which is $=V_{out}$) and $V_{ref\text{-}2}$ is seen at the inputs of the comparison engine 526. In the following discussion concerning the output of the comparison engine 526, it is important to note that as mentioned above, in the preferred embodiment, the analog comparison engine 560 is used to provide a continuous signal range of control to the current consuming transistor M3 so as to control the current consuming transistor M3 over a continuous range. Of course, if the digital comparator 528 embodiment is implemented, the comparison engine 526 provides either an on or off signal to the current consuming transistor M3.

In accordance with the embodiment implementing the analog comparison engine 560, when the voltage difference ($V_{ref\text{-}1}-V_{ref\text{-}2}$) at the inputs of the comparison engine 526 is small, the output of the comparison engine is elevated and thus the power consuming transistor M3 is active to provide additional current draw. Because the analog comparison engine 560 provides a continuous analog output, the voltage difference ($V_{ref\text{-}1}-V_{ref\text{-}2}$) controls the degree to which the power consuming transistor M3 is turned on, and hence, its current draw.

Conversely, when the voltage difference ($V_{ref\text{-}1}-V_{ref\text{-}2}$) at the inputs of the comparison engine 526 is relatively large, the output of the comparison engine 560 is reduced, and thus the power consuming transistor M3 approaches a turned off or low drive state, such that little or no additional power is drawn by the power consuming transistor M3.

Note that the value of $V_{ref\text{-}1}-V_{ref\text{-}2}$ could be also negative as shown in FIG. 9. In that regard, the current consuming transistor M3 is active when ($V_{ref\text{-}1}-V_{ref\text{-}2}$)>0 (or a small value). Conversely, the current consuming transistor M3 is inactive when ($V_{ref\text{-}2}-V_{ref\text{-}1}$)>0 (or a small value)

To determine the operating point of the reference determining transistor M2, and thus the value of $V_{ref\text{-}2}$, the constant current source 514 is set to have a constant current draw equal to the current draw of the threshold load ($I_{threshold}$) targeted load divided by the ratio of M1/M2. Thus, if the power transistor M1 is 100 times larger than the reference determining transistor M2, and thus draws 100 times the amount of current, the constant current source 514 is configured to draw 1% of the targeted threshold load ($I_{threshold}$).

Note that the illustrated embodiment of the dynamic compensation circuit 310 show in FIG. 5 is one embodiment for implementing a secondary current draw on the power transistor M1. However, any suitable circuit that provides an additional current draw on the power transistor M1 so as to maintain the load on the power transistor M1 greater than a minimum current draw, may be used without departing from the scope of the invention. Further, the embodiment of FIG. 5 further improves the DC load performance of the linear voltage regulator 100 because the output current of the linear voltage regulator 100 varies to a lesser degree due to the dynamic compensation circuit 310.

For example, if the current draw of the target load is 100 mA, the constant current source 514 is configured to draw 1 mA, assuming a ratio of 100:1 between M1 and M2. Thus, at the target load value of 100 mA, the comparison engine 526 turns off current consuming transistor M3 because there is now sufficient current draw provided by the dynamic load 120.

Figure 6:
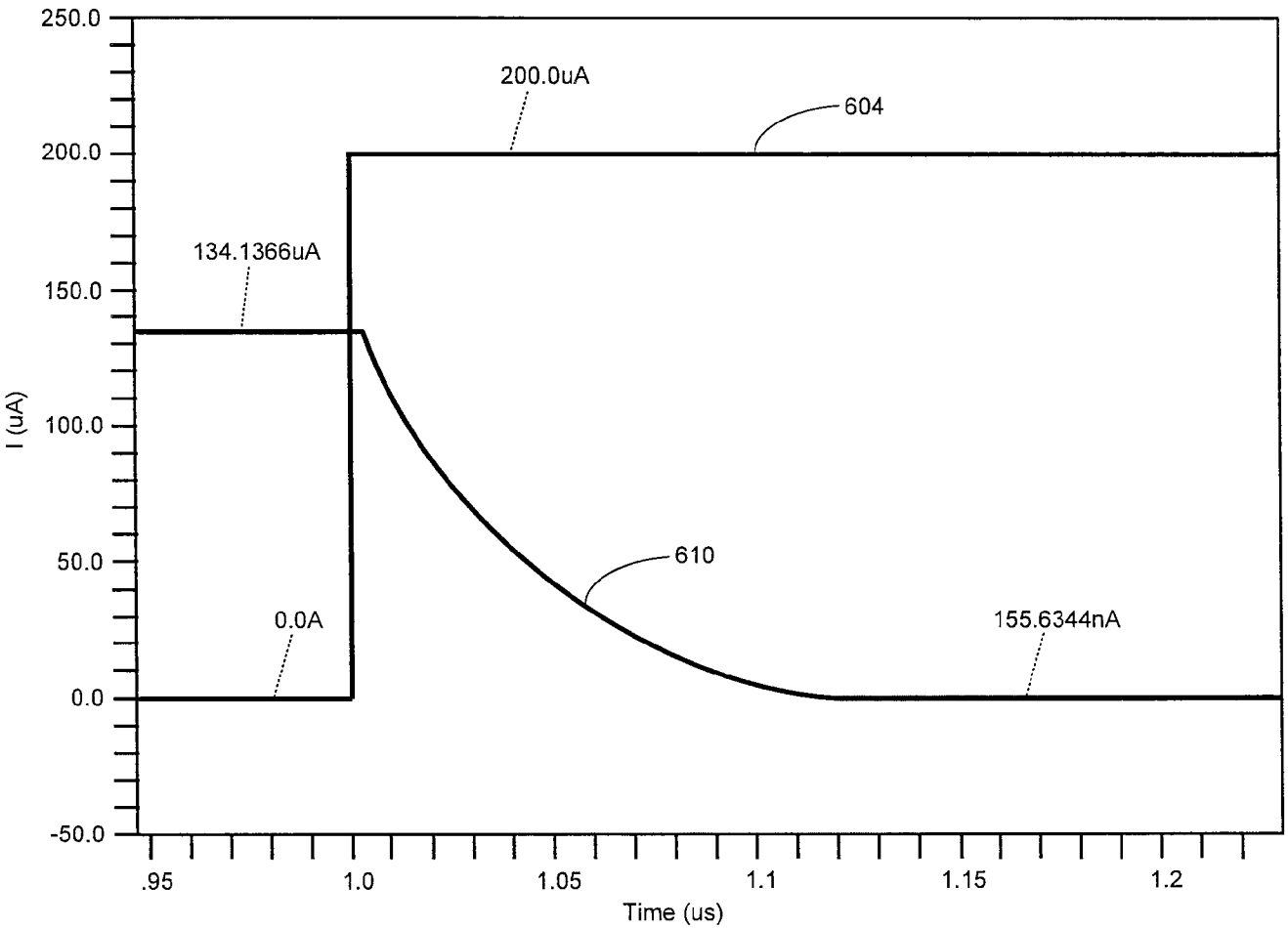
FIG. 6 is a waveform showing current draw of the dynamic load and the output of the dynamic compensation circuit.

To further explain the above, FIG. 6 is a graph 600 showing current draw 604 of the dynamic load 120 and the response of the dynamic compensation circuit 310, and in particular, the output 610 of the current consuming transistor M3. As shown, the current draw caused by the dynamic load 120 turning on increases very rapidly at time=1 μs from about zero to about 200 μA.

Also note that prior to time=1 μs, the current consuming transistor M3 provides a constant additional load of about 134 μA from time=0.95 μs to about 1.0 μs. This is because the dynamic load 120 is off and thus is not drawing a sufficient amount of current. Accordingly, the current consuming transistor M3 provides the additional load.

At about time=1 μs, the current drawn by the dynamic load 120 increases rapidly, and in response thereto, the output of the current consuming transistor M3 begins to decrease, and reaches a steady state at about time=1.15 μs, while drawing an extremely low current of about 155.6 nA. This represents an off state of the current consuming transistor M3.

Figure 7:
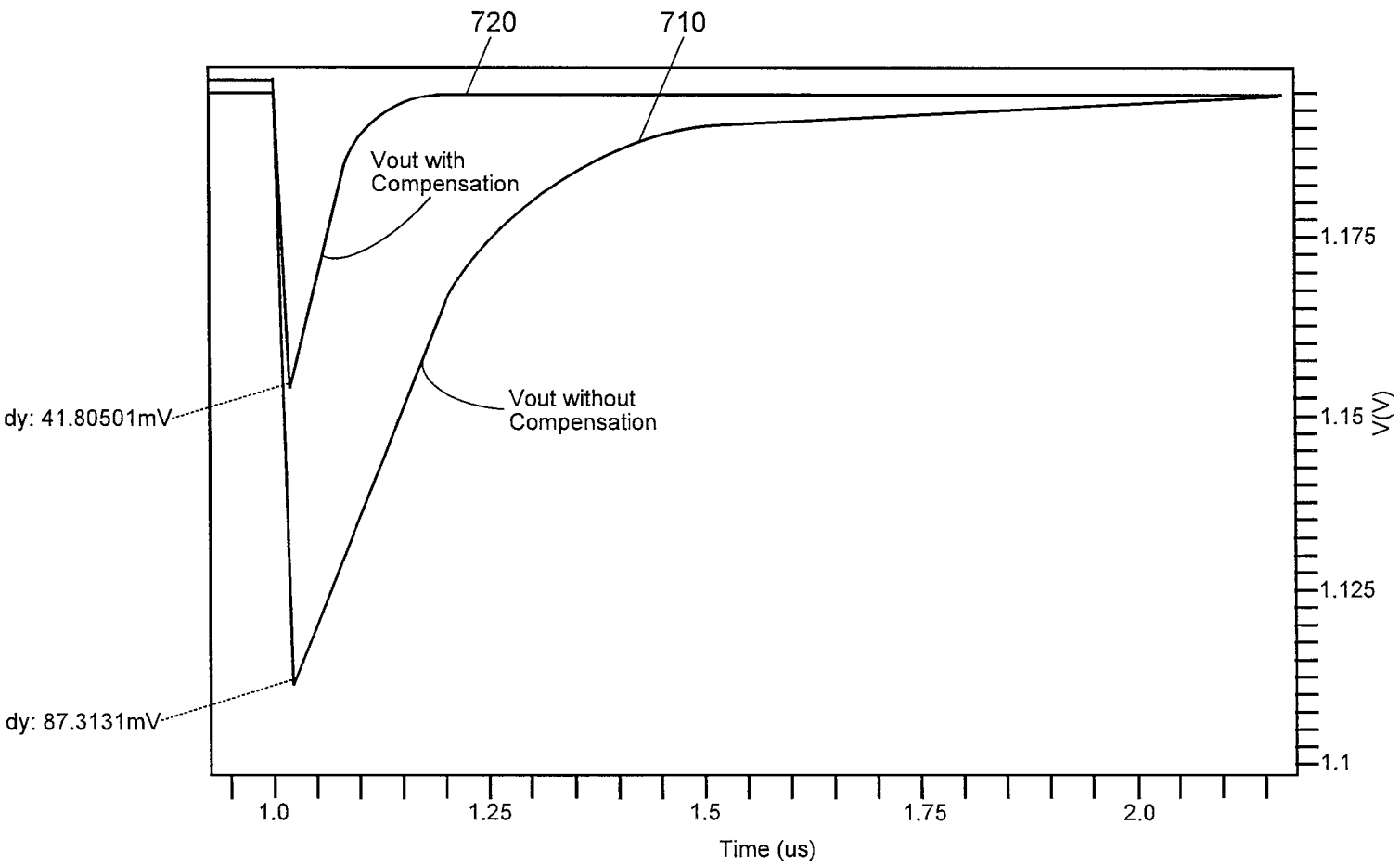
FIG. 7 is a waveform showing the output of the linear voltage regulator with and without the dynamic compensation circuit.

Referring now to FIG. 7, a graph 700 shows $V_{out}$ 710 corresponding to the linear voltage regulator 100 when the dynamic compensation circuit 310 is not used, based on empirical laboratory measurements. Note that $V_{out}$ spikes substantially at about time=1.03 μs when the dynamic load 120 initially begins to draw current, and drops about 87 mV from its steady state output voltage. When the dynamic compensation circuit 310 is used, however, $V_{out}$ 720 exhibits a much less severe spike, and drops only about 41.9 mV. Thus, the dynamic compensation circuit 300 mitigates the voltage drop caused by switching of the dynamic load 120.

Figure 8:
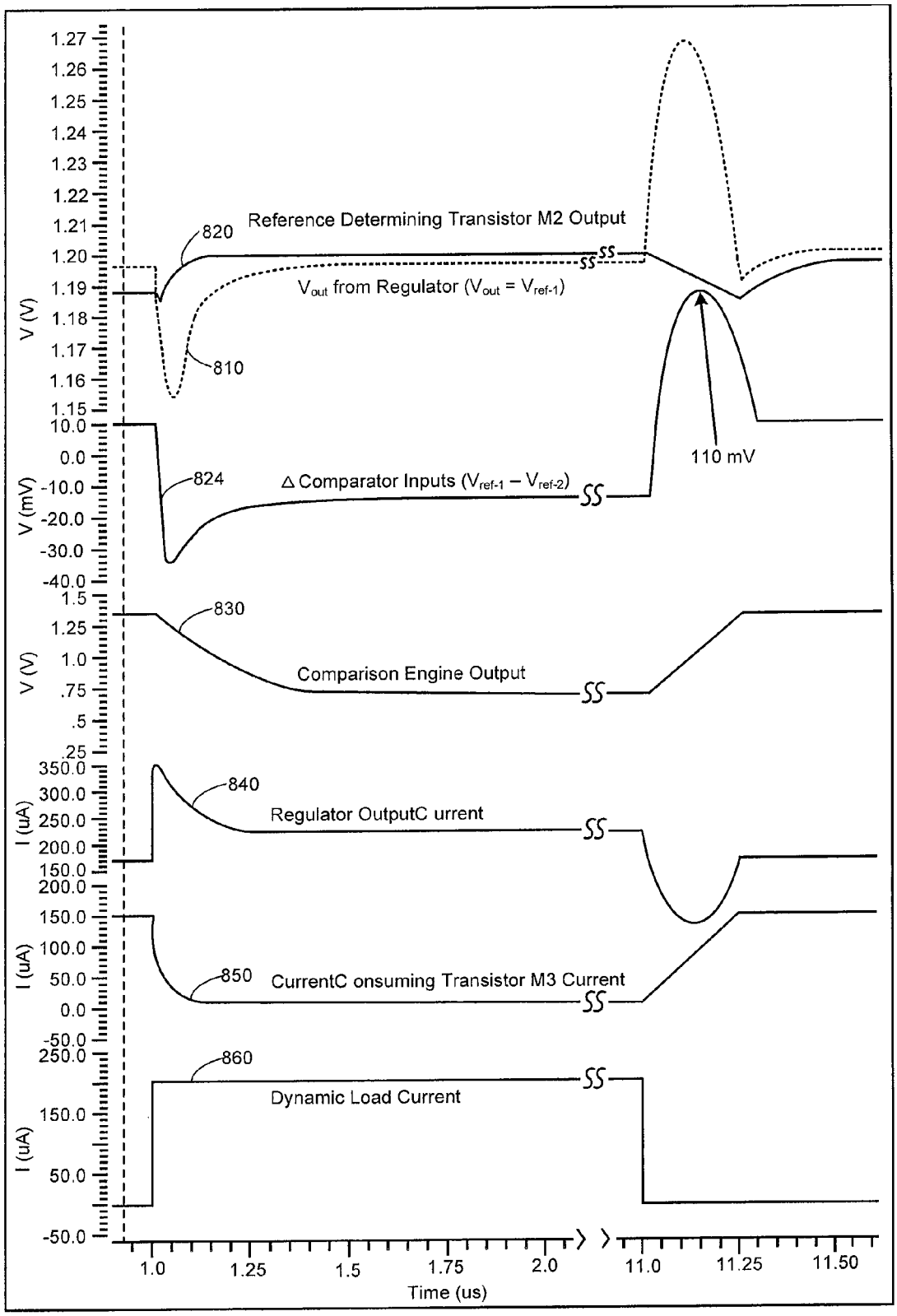
FIG. 8 is a waveform showing various voltages and currents of the dynamic compensation circuit.

Referring now to FIG. 8, a graph 800 show various signals of the dynamic compensation circuit 310, and is applicable to the embodiment using the analog comparison engine 560 as the comparison engine 526. From top to bottom, the graph shows the following: 1) $V_{ref\text{-}2}$ 820, which is the same as second input of the comparison circuit 526, and is also the same as the output of the reference determining transistor M2; 2) $V_{out}$ or $V_{ref\text{-}1}$ 810, which is same as first input of the comparison engine 526; 3) the difference in voltage 824 as applied to the inputs of the comparison engine 526, or in other words, $V_{ref\text{-}1}-V_{ref\text{-}2}$; 4) output 830 of the comparison engine, which is the same as the gate input of current consuming transistor M3; 5) output current 840 of the power transistor M1; 6) current 850 through current consuming transistor M3; and 7) current load 860 of the dynamic load 120.

At time <1 μs, the current load 860 of the dynamic load 120 is about zero because the dynamic load 120 is not drawing current, and $V_{out}$ 810 is at steady state at about 1.20 volts. $V_{ref\text{-}2}$ 820, which is the same as the second input of the comparison engine 560 and is also the same as the output of transistor M2, is slightly greater than $V_{out}$, and is also at a steady state voltage of about 1.19 volts. The difference in voltage 824 as seen at the input of the comparison engine 526 ($V_{ref\text{-}1}-V_{ref\text{-}2}$) is about +10 mV. Thus, $V_{ref\text{-}1}$ (810) is greater than $V_{ref\text{-}2}$ (820) at this time, but by a small amount.

Accordingly, the output 830 of the comparison engine 560 is at a relatively high value, in this case, about 1.37 volts, which directs the current consuming transistor M3 to turn on and consume current. Note that this is a continuous function and the degree to which the comparison engine 520 turns on the current consuming transistor M3 is a function of the difference between $V_{out}$ (810) and $V_{ref\text{-}2}$ (820).

As shown, the current 850 through current consuming transistor M3 is relatively high, at about 151 μA, as it is driven into the active state. The current consuming transistor M3 is driven to consume current because the current load 860 of the dynamic load 120 is too low. Accordingly, because only the current consuming transistor M3 is on (and the dynamic load is off), the output current 840 of the power transistor M1 is relatively low, about 162.2 uA.

Next, at about time=1 μs, the current load 860 of the dynamic load 120 increases rapidly to about 200 μA as the dynamic load turns on and draws current. Due to this current draw, $V_{out}$ 810 begins to drop, and drops to a low value of about 1.16 volts. $V_{ref\text{-}2}$ 820 thus begins to increase and becomes greater than $V_{out}$ 810.

Accordingly, $V_{ref\text{-}2}$ (820) becomes greater than $V_{out}$ (810) at this time, and the difference continues to grow as $V_{out}$ continues to fall. The difference in voltage 824 as seen at the input of the comparison engine 526 ($V_{ref\text{-}1}-V_{ref\text{-}2}$) increases to a delta of about 50 mV (10 mV to −40 mV). Accordingly, the output 830 of the comparison engine 520 begins to fall from its relatively high steady state value, and falls off smoothly. As the output 830 of the comparison engine 560 falls, the current consuming transistor M3 begins to become less active, and draws less current. Again, note that this is a continuous function (rather than on or off) and the degree to which the comparison engine 520 turns off or reduces the output of the current consuming transistor M3, is a function of the difference between $V_{out}$ (810) and $V_{ref\text{-}2}$ (820).

As shown, the current 850 through current consuming transistor M3 begins to drop as its output is reduced under control from the comparison engine 526. The current consuming transistor M3 is driven to approach the turned off state because the current load 860 of the dynamic load 120 has increased to a sufficient level. Accordingly, because current consuming transistor M3 is drawing minimal current, while the dynamic load draws most of the current, the output current 840 of the power transistor M1 drops from it elevated level to a steady state level as it supplies power to the dynamic load 120.

Sometime after about time=1.50 μs, the circuit reaches a steady state with the linear voltage regulator 100 is providing a regulated output voltage $V_{out}$ to the dynamic load 120. During this time, the difference in voltage 824 as seen at the input of the comparison engine 526 ($V_{ref\text{-}1}-V_{ref\text{-}2}$) is at a middle level, or at about −6 mV. After about time=11.0 μs, the current load 860 of the dynamic load 120 decreases rapidly to about 0.0 μA as the dynamic load turns off and no longer draws current. The dynamic compensation circuit 310 reacts to this change, as shown in the various waveforms from time=11.0 μs to about time=11.30 μs. Thereafter, the system again reaches a steady state, similar to the state shown prior to about time=1.0 μs.

Figure 9A:
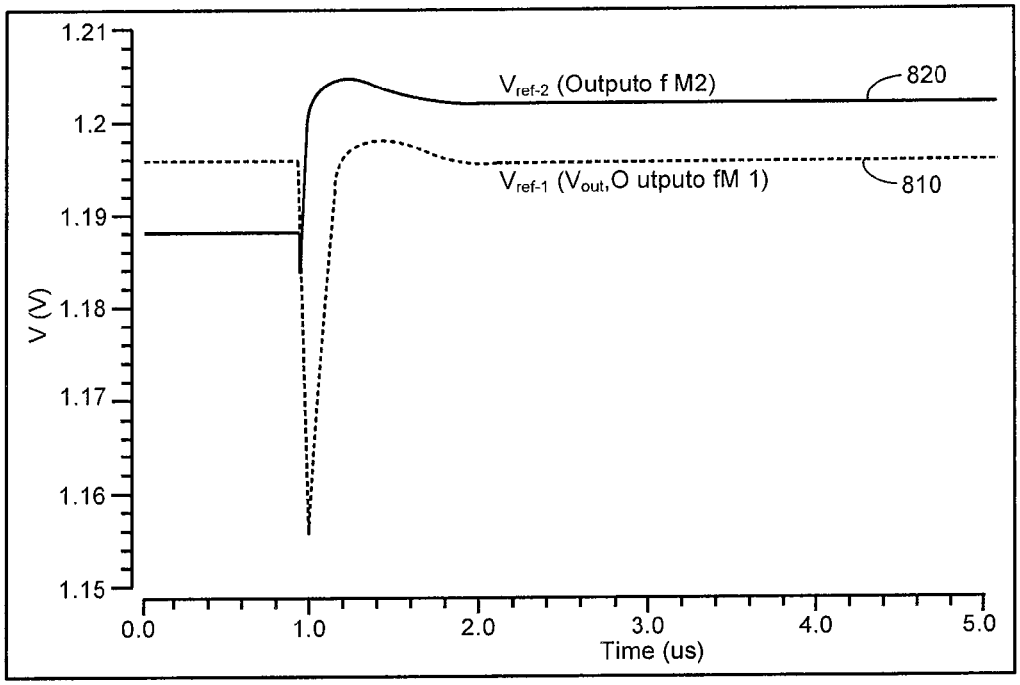
FIGS. 9A and 9B show waveforms $V_{ref\text{-}1}$ (=$V_{out}$) and $V_{ref\text{-}2}$ as seen at the inputs of the comparison engine.
Figure 9B:
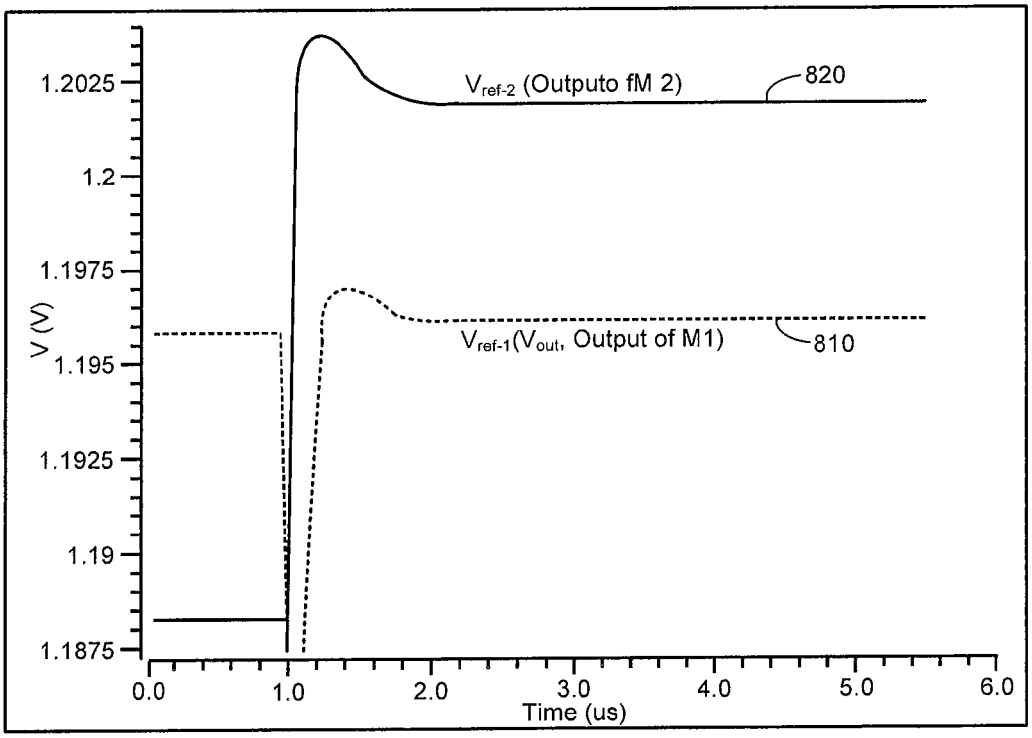

To further clarify the voltage levels present on the input of the comparison engine 526, please refer to FIGS. 9A and 9B, which shows the output ($V_{ref\text{-}1}$ or $V_{out}$, 810) relative to the output of the reference determining transistor ($V_{ref\text{-}2}$, 820), where the relative difference between the two inputs controls the way in which the comparison engine 526, in turn, controls the current consuming transistor M3.

As shown in FIG. 9A, at time <1 μs, for example, when the current load on the power transistor ($I_{load}$) is less than the threshold current load ($I_{threshold}$) on the power transistor M1 (meaning that ($I_{load}$)<($I_{thresh}$)), the output ($V_{out}$, 810) of the power transistor M1 is higher than the output ($V_{ref\text{-}2}$, 820) of reference determining transistor M2 due to the larger current flow. This occurs when the dynamic load is not drawing a sufficient amount of current from the power transistor M1. However, after time >1 μs, the output ($V_{ref\text{-}2}$, 820) of reference determining transistor M2 increases to a value greater than the output ($V_{out}$, 810) of power transistor M1 when the dynamic load draws current.

Conversely, as shown FIG. 9B, when the current load on the power transistor ($I_{load}$) is greater than the threshold current load ($I_{threshold}$) on the power transistor M1 (meaning that ($I_{load}$)>($I_{thresh}$)), such as when the dynamic load begins to draw current from the power transistor M1, the control gate of the power transistor M1 rises to compensate for the falling output voltage ($V_{out}$). This results in a rise in the output ($V_{ref\text{-}2}$, 820) of the reference determining transistor, as its current is held at a constant level by the constant current source. Thus, the output ($V_{ref\text{-}2}$, 820) of reference determining transistor M2 becomes greater than the output ($V_{out}$, 810) of the power transistor M1.

Although the invention has been described with respect to various system and method embodiments, it will be understood that the invention is entitled to protection within the full scope of the appended claims.

The invention claimed is:

1. A voltage regulator compensation circuit configured to provide power to a dynamic load, the compensation circuit comprising:

a power transistor configured to drive the dynamic load;

a reference determining transistor configured to establish a voltage reference proportional to a regulated output voltage of the power transistor;

a control circuit coupled to a control input of the power transistor and coupled to a control input of the reference determining transistor;

a comparison engine configured to compare the regulated output voltage and the voltage reference;

a current consuming transistor operatively coupled to an output of the power transistor and configured to provide a varying secondary load;

wherein the comparison engine is configured to control the current consuming transistor to increase current draw or decrease current draw from the power transistor based on a difference between the regulated output voltage and the voltage reference.

2. The compensation circuit of claim 1, wherein the comparison engine is a differential amplifier having an output configured to provide a continuously varying analog control signal.

3. The compensation circuit of claim 2, wherein the continuously varying analog control signal controls the current consuming transistor to operate within a range of current consumption.

4. The compensation circuit of claim 1, wherein the comparison engine is a digital comparator having an output configured to provide a digital control signal.

5. The compensation circuit of claim 4, wherein the digital control signal controls the current consuming transistor to operate in an on state or an off state.

6. The compensation circuit of claim 1, wherein the control circuit is a feedback circuit configured control the power transistor so that the voltage output of the power transistor provides a regulated output voltage having reduced output variation.

7. The compensation circuit of claim 1, wherein the power transistor and the reference determining transistor are identically controlled by the control circuit, and are biased at a same operating point when a ratio of a size of the power transistor to a size of the reference determining transistor is equal to a threshold current of the power transistor divided by a current through the constant current source.

8. The compensation circuit of claim 1, further including a constant current source coupled to an output of the reference determining transistor, wherein the constant current source causes the voltage reference of the reference determining transistor to vary as an operating point of the reference determining transistor changes under control of the control circuit.

9. The compensation circuit of claim 1, wherein the power transistor is fabricated to have a greater physical size and corresponding greater power capability than the reference determining transistor so as to establish a predetermined power ratio between the power transistor and the reference determining transistor, and wherein a ratio of current flow through the power transistor to a current flow through the reference determining transistor is set equal to the predetermined power ratio.

10. A voltage regulator compensation circuit configured to provide a voltage output and a current output to a dynamic load, the compensation circuit comprising:

a linear voltage regulator having:

a power transistor having an output coupled to the dynamic load;

the power transistor providing the regulated output voltage and the output current; and a control circuit coupled to a gate input of the power transistor and configured to control the power transistor;

an optimization circuit having:

a reference determining transistor configured to establish a voltage reference and a current threshold that are proportional to the regulated output voltage and the output current of the power transistor, respectively;

a gate input of reference determining transistor coupled to the gate input of the power transistor and controlled by the control circuit;

a comparison engine configured to compare the regulated output voltage and the voltage reference;

a current consuming transistor operatively coupled to the output of the power transistor and configured to provide a varying secondary load, the current consuming transistor controlled by the comparison engine;

wherein the comparison engine controls the current consuming transistor to increase current draw or decrease current draw from the power transistor based on the difference between the regulated output voltage and the voltage reference.

11. The compensation circuit of claim 10, wherein the comparison engine is a differential amplifier having an output configured to provide a continuously varying analog control signal.

12. The compensation circuit of claim 11, wherein the continuously varying analog control signal controls the current consuming transistor to operate within a range of current consumption.

13. The compensation circuit of claim 10, wherein the comparison engine is a digital comparator having an output configured to provide a digital control signal.

14. The compensation circuit of claim 13, wherein the digital control signal controls the current consuming transistor to operate in an on state or an off state.

15. The compensation circuit of claim 10, wherein the control circuit is a feedback circuit configured control the power transistor so that the voltage output of the power transistor provides a regulated output voltage having reduced output variation.

16. The compensation circuit of claim 10, wherein the power transistor and the reference determining transistor are identically controlled by the control circuit, and are biased at a same operating point when a ratio of a size of the power transistor to a size of the reference determining transistor is equal to a threshold current of the power transistor divided by a current through the constant current source.

17. The compensation circuit of claim 10, wherein the current consuming transistor is controlled to provide an additional load on the power transistor when the dynamic load provides less than a predetermined load, such that the load on the power transistor is maintained at greater than a minimum load value.

18. The compensation circuit of claim 17, wherein maintaining the load on the power transistor at a level greater than the minimum load value reduces variation in the voltage output of power transistor during switching of the dynamic load.

19. The compensation circuit of claim 10, further including a constant current source coupled to an output of the reference determining transistor.

20. The compensation circuit of claim 19, wherein the constant current source causes the voltage reference of the reference determining transistor to vary as an operating point of the reference determining transistor changes under control of the control circuit.

21. The compensation circuit of claim 10, wherein the power transistor is fabricated to have a greater physical size and corresponding greater power capability than the reference determining transistor so as to establish a predetermined size ratio between the power transistor and the reference determining transistor.

22. The compensation circuit of claim 10, wherein a ratio of current flow through the power transistor to a current flow through the reference determining transistor is set equal to the predetermined power ratio when load current on the power transistor equals the current threshold.

23. The compensation circuit of claim 22, further including a constant current source coupled to an output of the reference determining transistor, wherein the constant current source is configured to establish the current flow through the reference determining transistor.

24. The compensation circuit of claim 10, wherein the power transistor, the reference determining transistor, and the current consuming transistor are formed as p-type MOSFETs or n-type MOSFETs.

25. A method for compensating an output of a voltage regulator, comprising:

driving a dynamic load with a power transistor, the power transistor providing a regulated output voltage to the dynamic load;

selectively loading the power transistor with a current consuming transistor coupled to an output of the power transistor to provide a secondary load;

establishing, using a reference determining transistor, a voltage reference proportional to the regulated output voltage of the power transistor;

controlling, using a control circuit, a gate input of the power transistor and a gate input of the reference determining transistor;

comparing the regulated output voltage and the voltage reference;

wherein an output of the comparison engine controls the current consuming transistor to increase current draw or decrease current draw from the power transistor based on the difference between the regulated output voltage and the voltage reference.

* * * * *